United States Patent [19]

Takano et al.

[11] Patent Number: 4,614,384

[45] Date of Patent: Sep. 30, 1986

[54] ELECTRONIC CASH REGISTER

[75] Inventors: Akira Takano, Sagamihara; Yutaka Mizuno, Tokyo; Hiroyuki Ishikawa, Tokyo; Yoshiaki Honjo, Tokyo, all of Japan

[73] Assignee: Casio Computer Co., Ltd., Tokyo, Japan

[21] Appl. No.: 670,549

[22] Filed: Nov. 13, 1984

[30] Foreign Application Priority Data

Nov. 18, 1983 [JP] Japan ..... 58-216288

[51] Int. Cl.[4] ..... A47B 81/00

[52] U.S. Cl. ..... 312/281; 312/277

[58] Field of Search ..... 312/277, 280, 281, 237; 108/50; 248/240.1, 678; 186/52, 59, 61; 377/130; 235/2, 1 R, 7 R; 40/371; 211/1, 2, 6, 71, 126

[56] References Cited

U.S. PATENT DOCUMENTS

| | | | |
|---|---|---|---|
| D. 278,542 | 4/1985 | Kakiuchi et al. | D18/4 |
| 340,770 | 4/1896 | Davis | 235/7 R |
| 484,650 | 10/1892 | Carney | 235/7 R |
| 537,488 | 4/1895 | Sapp | 235/7 R |
| 693,473 | 2/1902 | Wessels | 235/7 R |
| 4,448,463 | 5/1984 | Amos | 312/257 A |

*Primary Examiner*—James T. McCall

*Attorney, Agent, or Firm*—Frishauf, Holtz, Goodman & Woodward

[57] ABSTRACT

An electronic cash register is provided with a box protruding from its back. The box has a frame portion for fixing the box to the electronic cash register. By fitting the frame portion on the electronic cash register, the box is fixed to the electronic cash register housing so as to project from its back. The electronic cash register is further provided with engaging portions on its back. Panels for advertisement are removably retained by means of the engaging portions.

14 Claims, 20 Drawing Figures

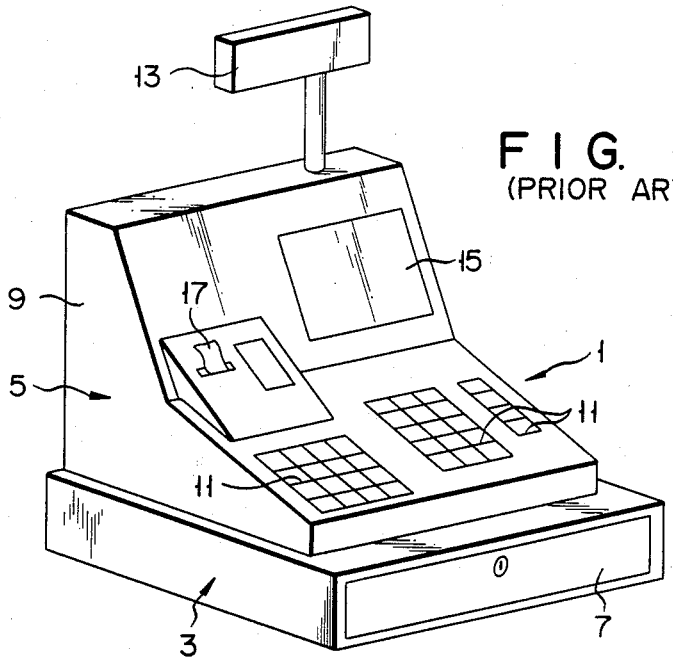
FIG. 1
(PRIOR ART)
FIG. 2
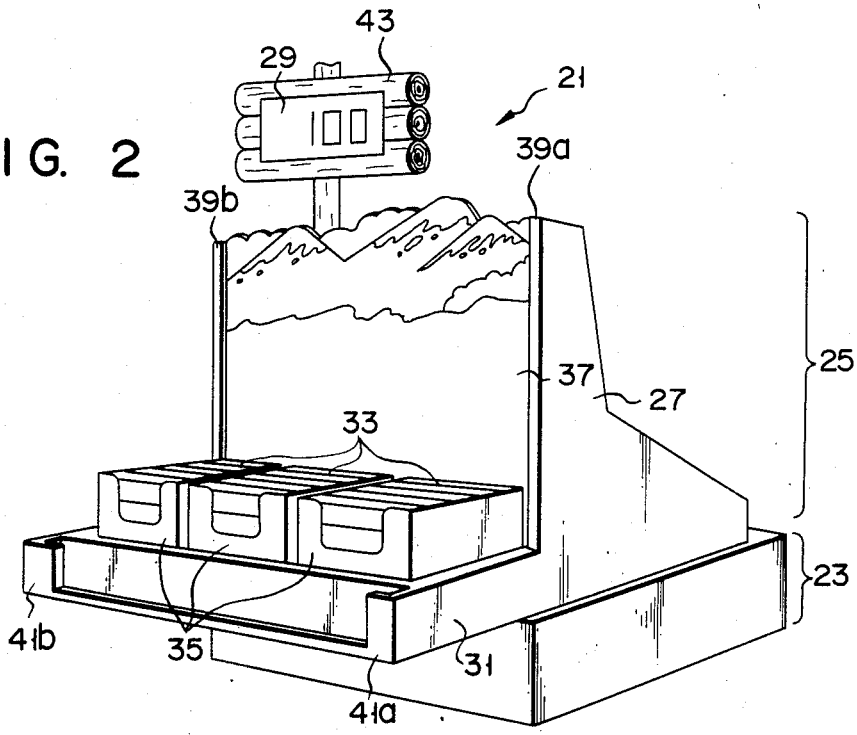

FIG. 18
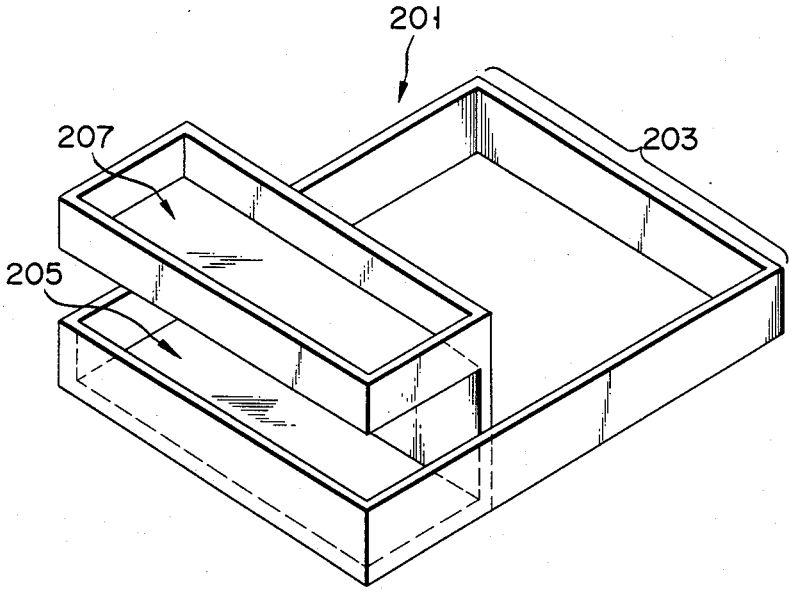
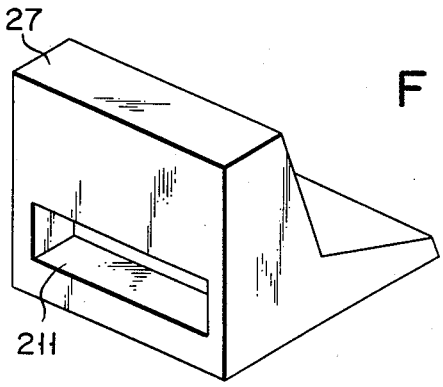
FIG. 19
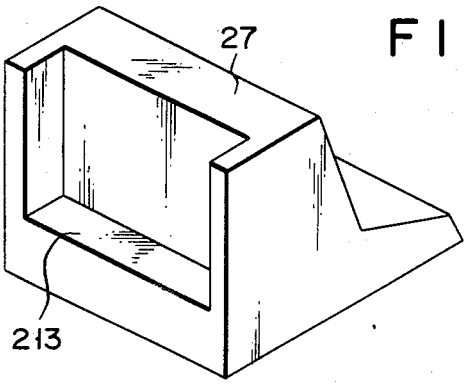
FIG. 20

ELECTRONIC CASH REGISTER

BACKGROUND OF THE INVENTION

The present invention relates to an improvement of an electronic cash register and, more specifically, to an electronic cash register in which a member for exhibiting and advertising commodities or other articles is attached to the back or lateral face of the housing of the electronic cash register. The back or lateral face of the housing conventionally has not been utilized.

FIG. 1 shows an example of conventional electronic cash registers which are used for registering sales data or other information in supermarkets or other shops. A prior art electronic cash register 1 comprises a cash drawer unit 3 and a register unit 5 mounted thereon. The cash drawer unit 3 is provided with a cash drawer 7 to receive and store money therein. The sales data processing unit 5 serves to register sales data. A keyboard 11 is provided on a casing 9 of the register unit 5. An operator registers sales data or other information by operating the keyboard 11. The data and process results are indicated on a rotary customer display 13 on the top of the casing 9 and an operator display 15, and are recorded on a receipt 17.

The prior art cash register 1 as shown in FIG. 1, however, serves only to register sales data without offering its top, back or lateral faces for any use. While the operator is processing the sales data, therefore, customers cannot help but stand idle, just watching the operator's process. Thus, there has been a demand for more effective use of the electronic register.

SUMMARY OF THE INVENTION

The present invention is contrived in consideration of these circumstances, and its object is to provide an electronic register offering its lateral face, back or other surfaces for effective use.

In order to attain the above object, an electronic register according to the present invention comprises an electronic cash register main body and article supporting means projecting from the back of the main body.

In the electronic cash register of the invention with the above arrangement, articles such as commodities and brochures can be exhibited on or in the supporting means. Thus, the electronic cash register may be used more effectively. Since the electronic cash register is expressly located in a place at which customers are always expected to stop for payment, the articles on the supporting means may be conspicuous enough to produce a high advertising effect, and thereby, arousing the customers' desire to buy.

BRIEF DESCRIPTION OF THE DRAWINGS

FIG. 1 is a perspective view of a prior art electronic cash register;

FIG. 2 is a perspective view of an electronic cash register according to a first embodiment of the present invention;

FIG. 18 is a perspective view showing boxes according to a ninth embodiment of the invention;

FIG. 19 is a perspective view of an electronic cash register according to a tenth embodiment of the invention; and FIG. 20 is a perspective view of an electronic cash register according to an eleventh embodiment of the invention.

DETAILED DESCRIPTION OF THE PREFERRED EMBODIMENTS

Figure 3:
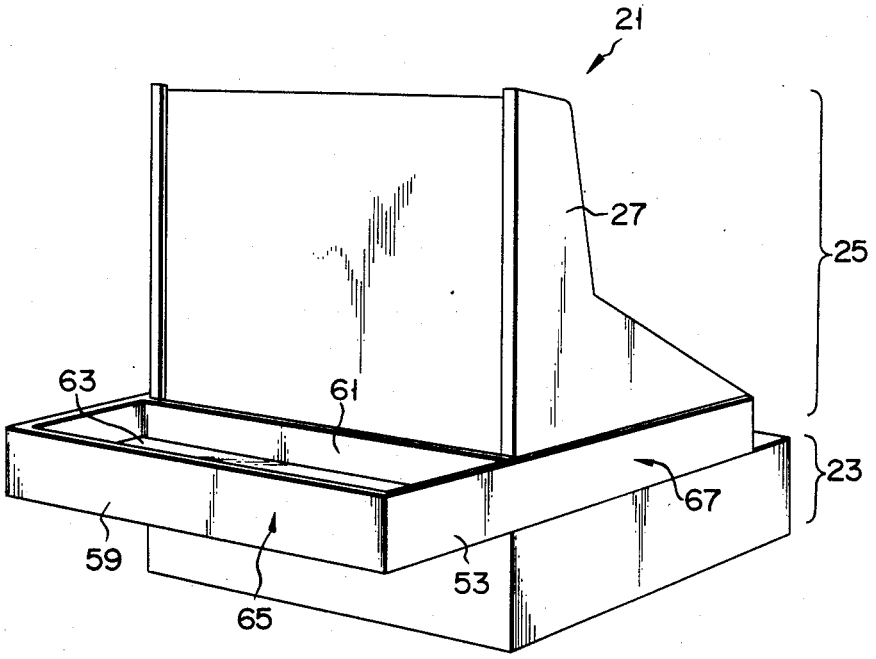
FIG. 3 is a perspective view of an electronic cash register according to a second embodiment of the invention.

Referring now to FIG. 2, an electronic cash register according to a first embodiment of the present invention will be described. FIG. 2 is a perspective view of the electronic register taken from the rear side. The register 21 comprises a cash drawer unit 23 and a register unit 25 mounted thereon. The drawer unit 23 includes a drawer (not shown) therein to receive and store money and the like. The register unit 25 registers sales data. A keyboard (not shown) is disposed on the front of a casing 27 of the register unit 25. If an operator registers the sales data by operating the keyboard, the data and process results are indicated on a display unit 29 on the top of the casing 27. This arrangement is substantially the same as that of the prior art electronic cash register shown in FIG. 1. This embodiment is characterized in that a box 31 for storing and exhibiting articles is formed integrally with the casing 27 at the lower portion of its back and protrudes therefrom. The box 31 is used for exhibiting relatively small commodities 33 such as chewing gum, chocolate, etc., or brochures and the like. In this embodiment, the commodities 33 are contained in proper cases 35, which are placed in the box 31. Alternatively, the commodities 33 may be exhibited directly in the box 31 without the use of the cases 35 or other vessels. The back of the casing 27 has at its sides engaging portions **39*a* and 39*b* for retaining a sheet member (panel) for advertisement. These portions 39*a*** and 39*b* are long and have an L-shaped cross section. Likewise, the back of the box 31 has at its sides engaging portions 41*a* and 41*b* for retaining an advertising panel. These portions 41*a* and 41*b* also have an L-shaped cross section. The engaging portions 39*a* and 39*b* and 41*a* and 41*b* may have a cross section other than an L-shaped one. Thus, a relatively large panel is set on the back of the casing 27, and a smaller one behind the box 31. In this embodiment, a panel 37 is disposed on the back of the casing 27 with the aid of the engaging portions 39*a* and 39*b*. A landscape for advertising the commodities 33 or other articles is painted on the surface of the panel 37. The display unit 29 is in the form of a rectangular box which can rotate on the top of the casing 27. An ornamental member 43 surrounds the display unit 29. The ornamental member 43 is a plastic sheet which is designed and shaped, for example, in compliance with the information on the advertising panel 37.

In the electronic cash register 21 with this construction, the commodities 33 or brochures can easily be exhibited in the box 31 which protrudes from the back of the casing 27. Thus, while the operator is registering sales data and the like, customers can watch not only the operator processing but the commodities 33 in the box 31. Since the electronic cash register 21, in particular, is set in a place at which the customers are always expected to stop for payment, it is very advisable, from the point of view of advertisement, to exhibit the commodities 33 or other articles in the box 31. Exhibited on the back side of the electronic register 21, moreover, the commodities 33 or other articles are so conspicuous that they can arouse the customers' desire to buy them. Also, a panel, such as the panel 37, is removably attached to the back of the casing 27 or the box 31. The use of the panel heightens the effect of advertisement for the commodities 33. According to this embodiment, as described above, the lateral faces and the back of the electronic cash register 21, which conventionally have not been used, can effectively be utilized. Integrally formed on the casing 27, moreover, the box 31 can be manufactured and assembled with ease.

For ease of understanding, the reference numerals used in FIG. 2 are utilized throughout the following descriptions of the other embodiments to specify the same parts.

Figure 4:
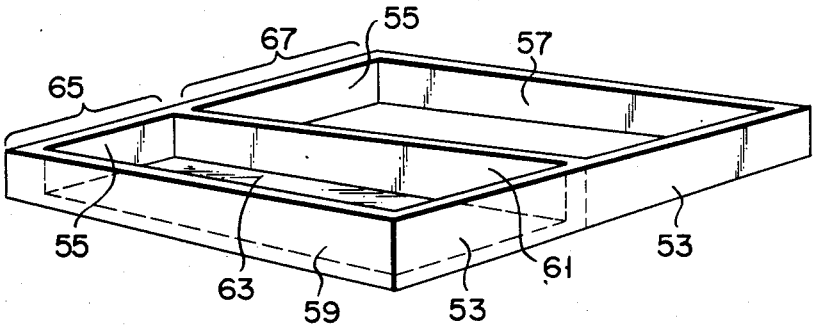
FIG. 4 is a perspective view of a box shown in FIG. 3.

Referring now to FIGS. 3 and 4, a second embodiment of the invention will be described. In this second embodiment, a box 65 for exhibition is removably attached to the housing of the electronic register 21.

The box 65 is integrally formed with a frame portion 67. As shown in FIG. 3, the frame portion 67 can be fitted on the casing 27. The combination of the box 65 and the frame portion 67, as shown in FIG. 4, includes a facing pair of side plates 53 and 55, another facing pair of side plates 57 and 59 connecting the ends of the side plates 53 and 55, a side plate 61 extending parallel to the side plates 57 and 59 to connect the side plates 53 and 55 and dividing the box 65 to support articles thereon from the frame portion 67 to be fixed to the register housing, and a bottom plate 63 closing the bottom end surrounded by the side plates 59, 53, 55 and 61. Thus, the side plates 53, 55, 59 and 61 and the bottom plate 63 constitute the box 65, and the side plates 53, 55, 57 and 61 constitute the frame portion 67. The box 65 and the frame portion 67 are integrally formed from, e.g., a plastic material. By fitting the casing 27 in the frame portion 67, the box 65 is fixed so as to project from the back of the electronic register 21, as shown in FIG. 3. The box 65 can be removed by disengaging the frame portion 67 from the casing 27. Also in this embodiment, commodities or other articles can be exhibited in the box 65, producing the same advertising effect as the first embodiment. The box 65, which can be removed when unnecessary, is easy to handle. The second embodiment is the best mode.

Figure 5:
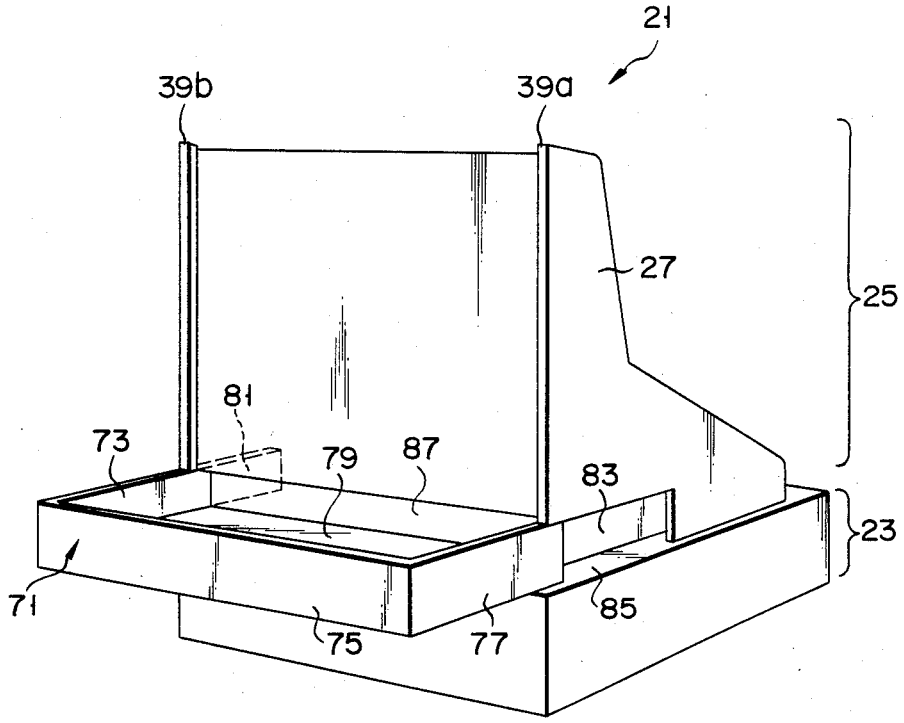
FIG. 5 is a perspective view of an electronic cash register according to a third embodiment of the invention.
Figure 6:
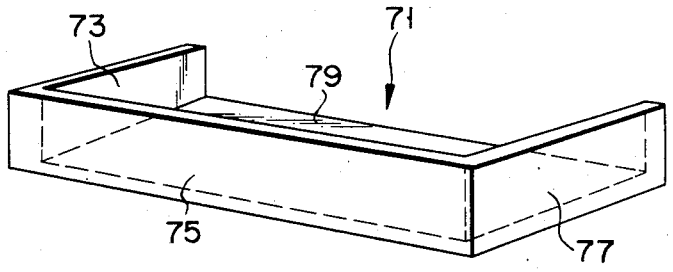
FIG. 6 is a perspective view of a drawer shown in FIG. 5.

Referring now to FIGS. 5 to 8, a third embodiment of the invention will be described. In this third embodiment, a drawer 71 in the shape shown in FIG. 6 is provided behind the casing 27, as shown in FIG. 5.

Figure 7:
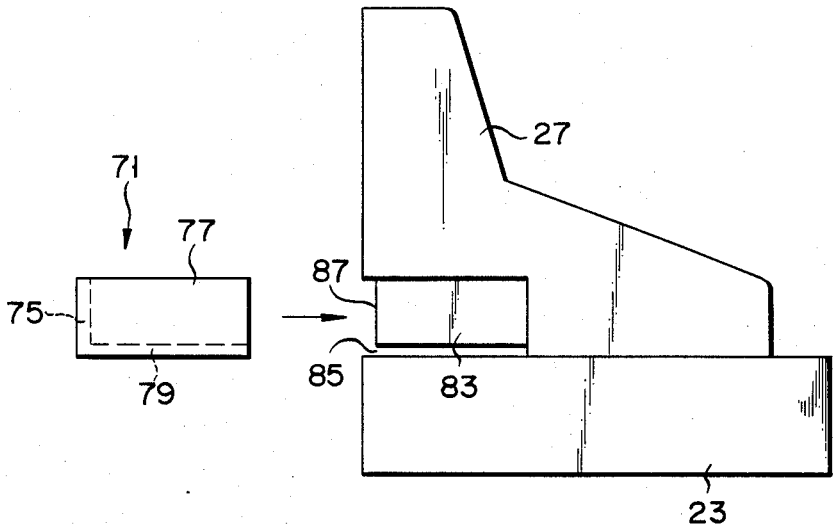
FIG. 7 is a side view relatively showing the housing of the electronic cash register and the drawer of FIG. 5.
Figure 8:
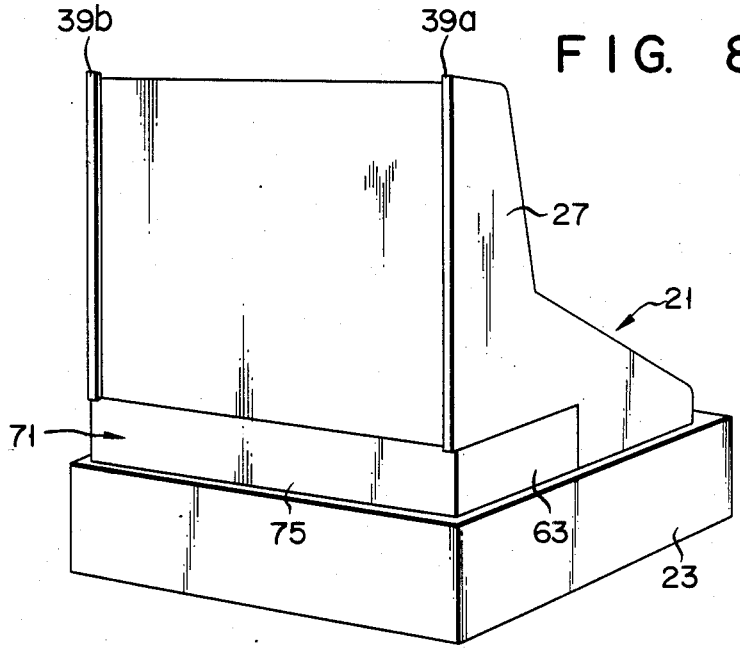
FIG. 8 is a perspective view of the electronic cash register of FIG. 5 containing the drawer therein.

As shown in FIG. 6, the drawer 71 is in the form of an open-topped box without one side plate, which consists of three side plates 73, 75 and 77 and a bottom plate 79. As shown in FIGS. 5 and 7, a pair of notchs 81 and 83 are formed individually on both sides of the bottom end portion of the casing 27 so as to receive the side plates 73 and 77, respectively, when the drawer 71 is pushed into the casing 27. Also, a notch 87 is formed in the lower end portion of the back of the casing 27 so as to receive the side plate 75 when the drawer 71 is inserted into the casing 27. The cut portions 81, 83 and 87 correspond to the side plates 73, 77 and 75, respectively, in shape and size. Likewise, an opening 85 is formed at the bottom end of the casing 27 to receive the bottom plate 79. When not needed, the drawer 71 is housed in the casing 27, as shown in FIG. 8. In this state, the outer surface of the drawer 71 is flush with that of the casing 27. When needed, the drawer 71 is drawn out as shown in FIG. 5. In this state, the inside of the register unit 25 is prevented from being seen by the outside through the cut portions 81, 83 and 87. Also in this third embodiment, commodities or other articles can be exhibited in the drawer 71, producing the same advertising effect of the first embodiment. The drawer 71, which can be housed in the casing 27 when not needed, is easy to handle.

Figure 9:
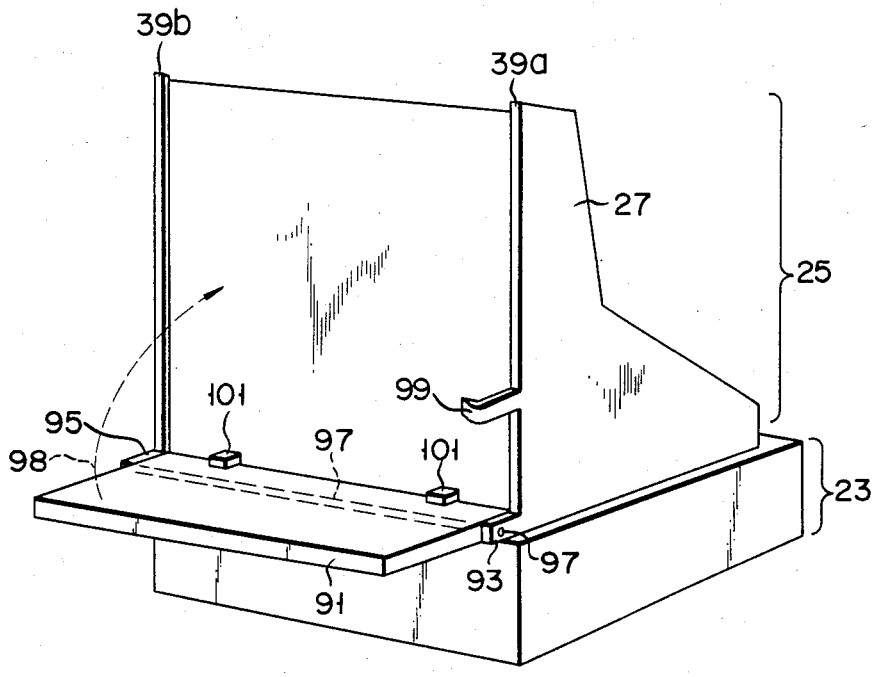
FIG. 9 is a perspective view of an electronic cash register according to a fourth embodiment of the invention.
Figure 10:
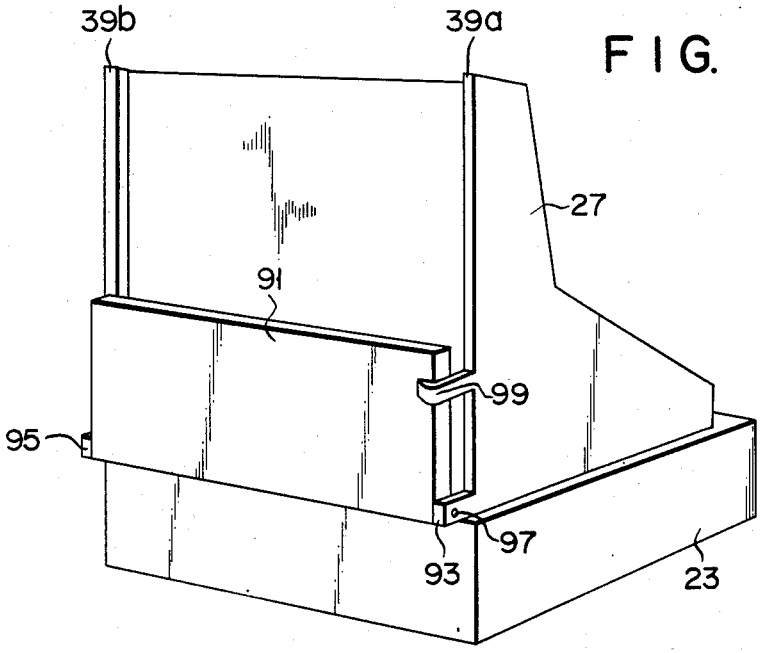
FIG. 10 is a perspective view of the electronic cash register of FIG. 9 with a board for bearing articles held along its back.

Referring now to FIGS. 9 and 10, a fourth embodiment of the invention will be described. This fourth embodiment is provided with a swingable rectangular board 91 to bear articles thereon.

A shaft 97 penetrates through one side portion of the board 91 along the longitudinal direction thereof. Mounting portions 93 and 95 protrude individually from both sides of the bottom end of the casing 27. The mounting portions 93 and 95 are integral with the casing 27. The shaft 97 is supported at each end by the mounting portions 93 and 95. The board 91 is supported by the shaft 97 so as to be swingable around it. When not needed, the board 91 is swung in the direction indicated by an arrow 98 in FIG. 9 to nestle close to the back of the casing 27, as shown in FIG. 10. In this position, the board 91 is prevented from falling down by a hook 99. When needed, on the other hand, the board 91 is swung down to be horizontal. Thereupon, the board 91 is kept in place by projecting stoppers 101 which are fixed to the back of the casing 27. Also in this fourth embodiment, commodities or other articles can be exhibited on the board 91, producing the same advertising effect as the first embodiment. The board 91, which can be held along the back of the casing 27 when not needed, is easy to handle.

Figure 11:
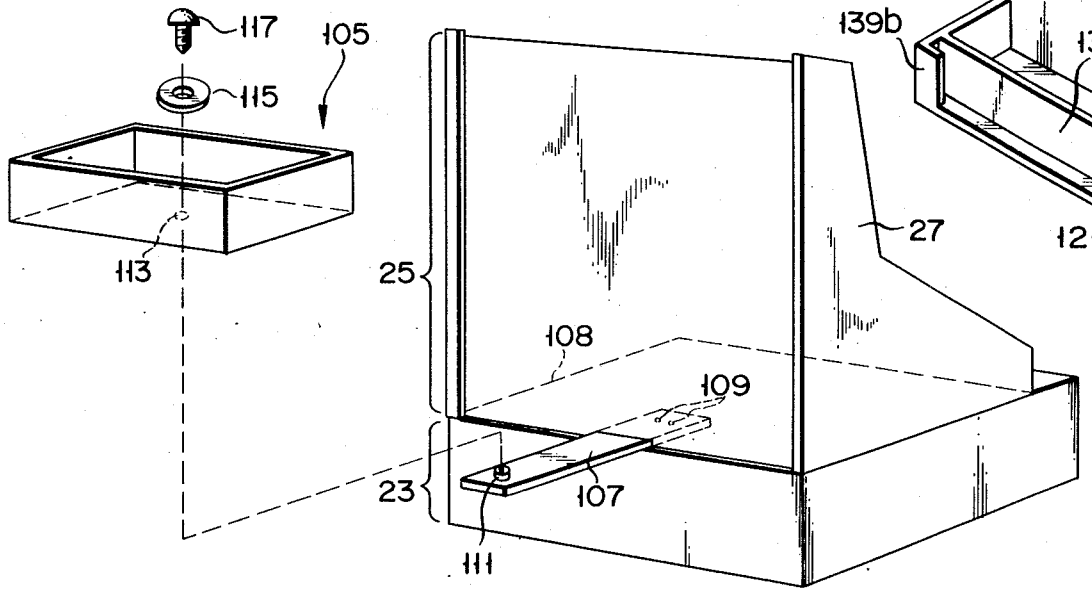
FIG. 11 is a disassembled perspective view showing the construction of an electronic cash register according to a fifth embodiment of the invention.

Referring now to FIG. 11, a fifth embodiment of the invention will be described. This fifth embodiment is provided with a rotatable box 105.

A supporting member 107 projects horizontally from the back of the casing 27. The supporting member 107 is fixed inside the casing 27 to a bottom plate 108, for example, by means of screws 109. A cylindrical projection 111 is attached to the distal end portion of the supporting member 107. The projection 111 is adapted to be fitted in a hole 113 which is in the center of the bottom plate of the box 105. The box 105 can rotate around the projection 111. The box 105 is prevented from coming off by a plate 115 and a screw 117. Also in this fifth embodiment, commodities or other articles can be exhibited in the box 105. Thus, customers can examine the commodities rotating in the box 105. In this case, therefore, the commodities are more conspicuous, producing a higher advertising effect than that of the first embodiment.

Figure 12:
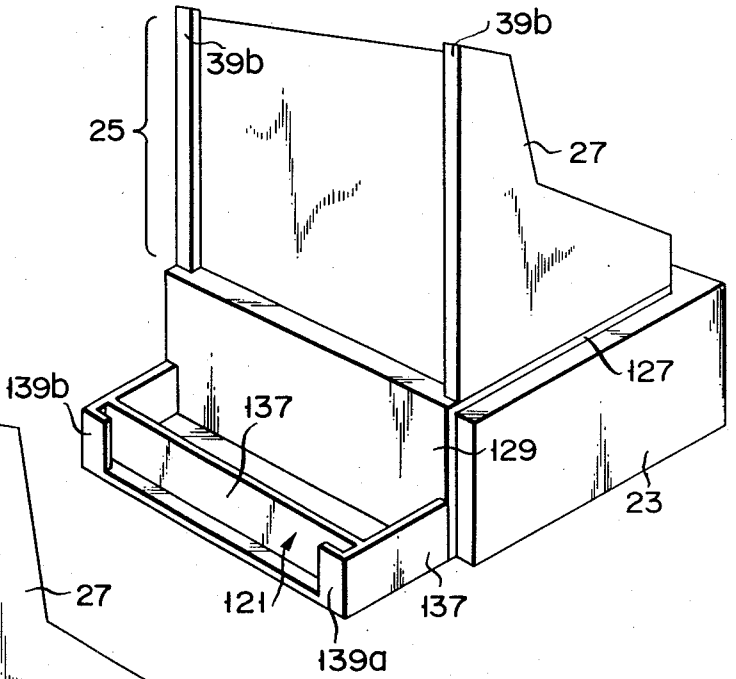
FIG. 12 is a perspective view of an electronic cash register according to a sixth embodiment of the invention.
Figure 13:
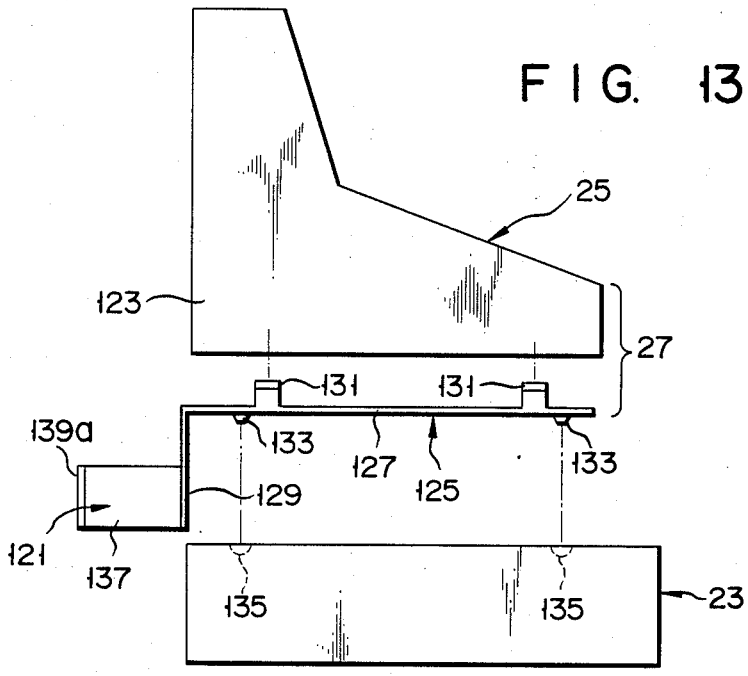
FIG. 13 is a disassembled side view showing the construction of the electronic cash register of FIG. 12.

Referring now to FIGS. 12 and 13, a sixth embodiment of the invention will be described. This sixth embodiment is provided with a removable box 121.

The casing 27 of the register unit 25 is formed of an upper case 123 and a bottom plate 125. The upper case 123 has substantially the same construction as the one used in the first embodiment. The bottom plate 125 is removably attached to the bottom portion of the upper case 123 and placed on the drawer unit 23. The bottom plate 125 is formed by bending a flat plate into two portions: a flat portion 127 and a retaining portion 129. The flat portion 127 corresponds to the bottom of the upper case 123. The retaining portion 129 is bent downward, projecting on the back side of the upper case 123. Engaging portions 131 protrude upward from both side edge portions of the flat portion 127. Positioning projections 133 are formed in suitable positions on the lower surface of the flat portion 127. The engaging portions 131 are upwardly inserted into the upper case 123, so the bottom plate 125 is removably attached to the bottom of the upper case 123. The positioning projections 133 are fitted in depressions 135 formed in the top face of the drawer unit 23. The box 121 is formed integrally with the retaining portion 129 of the bottom plate 125. The box 121 projects on the back side of the upper case 123 from the retaining portion 129. Outer peripheral surfaces 137 of the box 121 for exhibition constitute notice surfaces on which seals or the like for advertising the exhibited commodities are to be pasted. As in the first embodiment, the box 121 is provided with engaging portions 139*a* and 139*b* for removably retaining an advertising panel or the like. Likewise, the engaging portions 39*a* and 39*b* for removably holding an advertising panel or the like are formed on the back of the upper case 123. This sixth embodiment produces the same effect of the first embodiment. When not needed, the box 121 can be removed by disengaging the bottom plate 127 from the bottom of the upper case 123 and then attaching another bottom plate without a box to the upper case 123. Thus, the box 121 is easy to handle.

Figure 14:
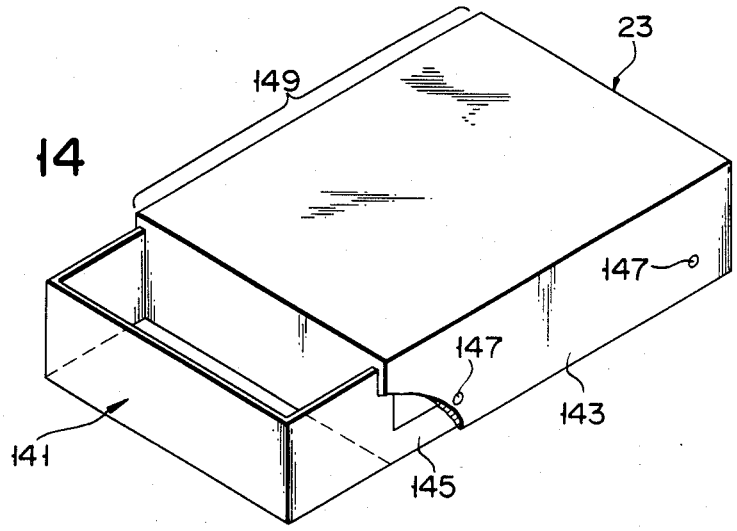
FIG. 14 is a perspective view of a drawer unit of an electronic cash register according to a seventh embodiment of the invention.
Figure 15:
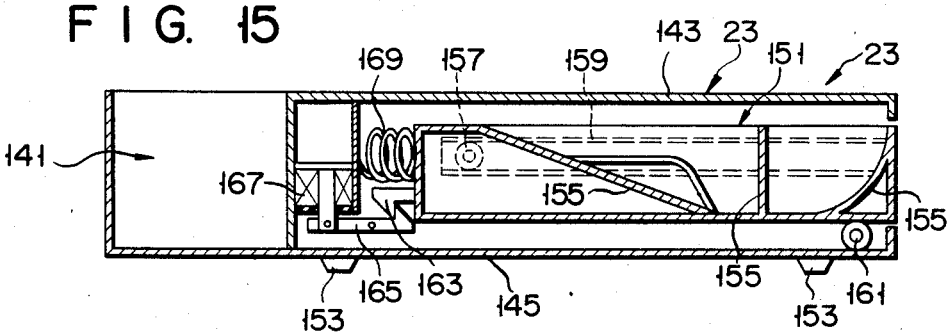
FIG. 15 is a sectional view of the drawer unit shown in FIG. 14.

Referring now to FIGS. 14 and 15, a seventh embodiment of the invention will be described. In this seventh embodiment, the drawer storage unit 23 is provided with a box 141 for exhibition.

The drawer unit 23 has a casing 149 which is formed of a bottom plate 145 and an upper case 143 attached thereto by means of screws 147. A drawer 151 is housed in the casing 149. The bottom plate 145 projects on the back side of the casing 149, and the box 141 is integrally formed on the bottom plate 145. The box 141 serves also to hold and exhibit commodities or other articles. Supporting legs 153 are attached to the under surface of the bottom plate 145. The drawer 151 serves to receive and store money and the like. The inside of the drawer 151 is suitably divided by partition walls 155, as shown in FIG. 15. A roller 157 on one side wall of the drawer 151 is supported so as to roll along guide rails 159 on the inner wall of the casing 149. The bottom face of the drawer 151 is supported by a roller 161 inside the casing 149. When the drawer 151 is housed in the casing 149, a hook 163 attached to the rear end wall of the drawer 151 is caught by an engaging member 165 in the casing 149. If a solenoid 167 is actuated as the electronic cash register 21 is operated, the engaging member 165 is disengaged from the hook 163, so that the drawer 151 is pushed out of the casing 149 by the urging force of a coil spring 169. This seventh embodiment may also provide the same advertising effect of the first embodiment.

Figure 16:
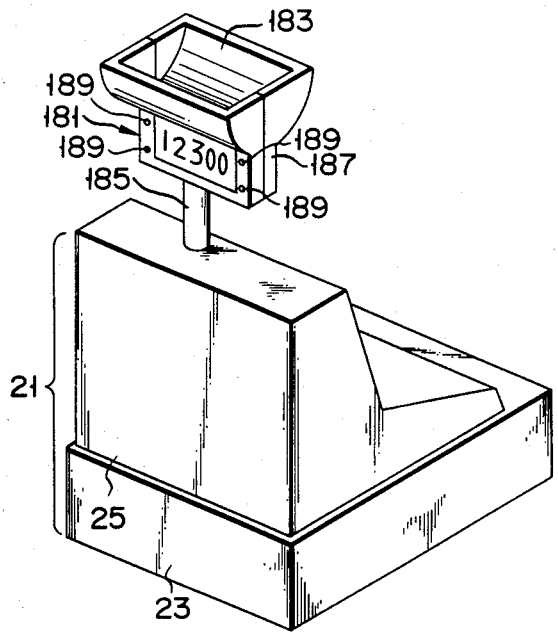
FIG. 16 is a perspective view of an electronic cash register according to an eighth embodiment of the invention.
Figure 17:
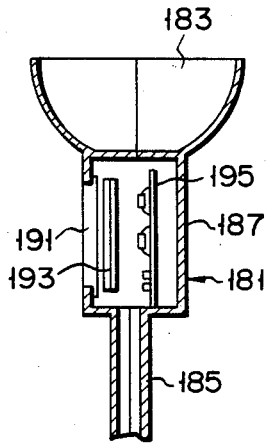
FIG. 17 is a sectional view of a receptacle shown in FIG. 16.

Referring now to FIGS. 16 and 17, an eighth embodiment of the invention will be described. In this eighth embodiment, a receptacle 183 for exhibition is provided on a display unit 181 of the electronic cash register 21.

The display unit 181, which is rotatably mounted on the top of the register unit 25 by means of a shaft 185, indicates data and process results in accordance with the operation of the register unit 25. The receptacle 183 is formed on the top of the display unit 181. The receptacle 183, which is in the form of a funnel-shaped box, contains therein commodities or other articles for exhibition. A casing 187 of the display unit 181, the receptacle 183 on the top of the casing 187, and the shaft 185 attached to the bottom of the casing 187 are integrally formed of a plastic material. The integral structure consisting of these three portions is split into halves and is assembled by coupling the halves together by means of screws 189. A transparent acrylic plate 191, liquid-crystal display panel 193, and a circuit board 195 are shown in FIG. 17. The circuit board 195 is electrically connected to the liquid-crystal display panel 193 and also to the register unit 25 by means of a cord (not shown) passed through the shaft 185. The display unit 181 with this construction may produce the same advertising effect of the first embodiment. Although the receptacle 183 is provided on the top of the display unit 181 in the eighth embodiment, it may also be formed on the lateral face, back or lower front portion of the display unit 181. Alternatively, the receptacle 181 may be provided on each of the top, lateral face, back and lower front portion of the display unit 181 or on the periphery of the shaft 185. Moreover, the receptacle 183 may have on its outer peripheral surface a notice surface on which are pasted seals or the like for advertising exhibited commodities or other articles. Alternatively, the display unit 181 may be provided with engaging portions for removably retaining panels or the like for advertisement.

In the first to eighth embodiments described above, a single box or board is used for exhibiting articles. The present invention is not, however, limited to those embodiments. For example, a plurality of boxes or a plurality of boards may be attached to the casing 27, the drawer unit 23, or the display unit 181. FIG. 18 shows a ninth embodiment of the invention, in which the box shown in FIG. 4 is modified into a two-stage version 201. In this embodiment, boxes 205 and 207 are integrally formed in two stages arranged in the vertical direction. The combination of the boxes 205 and 207 is integrally formed with a frame portion 203 to be fitted on the casing 27.

In the embodiments described above, the member(s) for supporting and exhibiting the article is attached to the back of the electronic cash register 21 or to the display unit 181. Alternatively, however, the member(s) for supporting the article may be provided on the top or lateral face of the electronic cash register or at various positions.

In the first to eighth embodiments, the means for supporting articles has been described as a box(es) or board(s). The means for supporting may, however, be of any other shape and material, provided it can support or bear articles thereon. For example, the boxes 31, 65, 71 and 105 of the first, second, third and fifth embodiments may be modified into board-shaped versions, and the board 91 of the fourth embodiment into a box-shaped version.

In the embodiments described above, moreover, the box(es) or board(s) for supporting articles projects from the electronic cash register 21. As shown as a tenth embodiment in FIG. 19, however, a recess 211 may be formed in the casing 27 to hold and exhibit articles. Alternatively, as shown as an eleventh embodiment in FIG. 20, an open-topped recess 213 may be formed in the casing 27.

What is claimed is:

1. An electronic cash register, comprising:

an electronic cash register main body having a back side arranged to face toward a customer making a payment to be registered; and supporting means, protruding from the back side of said electronic cash register main body, for supporting articles thereon to be sold and for displaying the articles to the customer.

2. An electronic cash register according to claim 1, further comprising retaining means for retaining said supporting means removably on the electronic cash register main body, so that said supporting means is fixed to said electronic cash register main body when needed and can be removed from said electronic cash register main body when it is not needed.

3. An electronic cash register according to claim 1, further comprising engaging means provided on the back side of said electronic cash register main body for retaining a sheet member.

4. An electronic cash register according to claim 3, wherein said supporting means includes an engaging means for retaining a sheet member.

5. An electronic cash register, comprising:

a register unit for registering at least sales data;

a drawer unit for storing money;

a frame adapted to be removably fitted on said register unit in such a manner as to surround said register unit; and supporting means, integrally formed on said frame to project from the back of said register unit when said frame is fitted on said register unit, for supporting articles to be sold thereon and for displaying the articles to a customer.

6. An electronic cash register according to claim 5, wherein said electronic cash register has a plurality of supporting means arranged one above another.

7. An electronic cash register according to claim 2, further comprising engaging means provided on the back side of said electronic cash register main body for retaining a sheet member.

8. An electronic cash register according to claim 2, wherein said supporting means includes an engaging means for retaining a sheet member.

9. An electronic cash register according to claim 2, wherein said retaining means is a frame adapted to be fitted on said electronic cash register main body so as to surround said electronic cash register main body.

10. An electronic cash register according to claim 5, wherein said frame surrounds said register unit in a horizontal plane when said frame is fitted on said register unit.

11. An electronic cash register according to claim 5, further comprising engaging means on the back of said register unit for retaining a sheet member.

12. An electronic cash register according to claim 11, wherein said supporting means includes an engaging means for retaining a sheet member.

13. An electronic cash register, comprising:

an electronic cash register main body;

supporting means for supporting articles to be sold thereon; and retaining means on said main body for slidably retaining said supporting means, so that said supporting means can be drawn out of and received in said electronic cash register main body as desired.

14. An electronic cash register according to claim 13, further comprising engaging means provided on a back side of said electronic cash register main body for retaining a sheet member.

* * * * *